United States Patent [19]

Gacsay

[11] Patent Number: 4,640,315

[45] Date of Patent: Feb. 3, 1987

[54] PROJECTILE WEAVING MACHINE

[75] Inventor: Lorant Gacsay, Zurich, Switzerland

[73] Assignee: Sulzer Brothers Limited, Winterthur, Switzerland

[21] Appl. No.: 803,716

[22] Filed: Dec. 2, 1985

[30] Foreign Application Priority Data

Dec. 18, 1984 [CH] Switzerland ..... 05990/84

[51] Int. Cl.[4] ..... D03J 1/00; D03D 47/24

[52] U.S. Cl. ..... 139/1 C; 139/439

[58] Field of Search ..... 139/434, 438, 439, 302, 139/194, 1 C

[56] References Cited

U.S. PATENT DOCUMENTS

| | | | |
|---|---|---|---|
| 2,034,487 | 3/1936 | Rossmann | 139/434 |
| 2,599,731 | 6/1952 | Whewell | 139/439 |
| 3,083,738 | 4/1963 | Pfarrwaller et al. | 139/302 |
| 3,604,466 | 9/1971 | Strauss | 139/1 C |
| 4,546,799 | 10/1985 | Riesen | 139/1 C |

FOREIGN PATENT DOCUMENTS

| | | | |
|---|---|---|---|
| 9428 | 3/1976 | Japan | 139/439 |

*Primary Examiner*—Henry S. Jaudon

*Attorney, Agent, or Firm*—Kenyon & Kenyon

[57] ABSTRACT

The projectile weaving machine has a return conveyor disposed between a catcher and a picking mechanism. In addition, a cutting device is provided on the catcher side for severing the weft yarn end before the release of the weft yarn end from the projectile. A blowing nozzle and suction tube are located either adjacent to the cutting device on the catching side or adjacent to a lift on the picking side in order to remove the severed weft yarn end from a projectile when the projectile is subsequently opened.

12 Claims, 5 Drawing Figures

PROJECTILE WEAVING MACHINE

This invention relates to a projectile weaving machine. More particularly, this invention relates to a projectile weaving machine and a method of picking a weft yarn into a weaving shed.

As is known, various types of projectile weaving machines have been constructed for the picking of weft yarns into a weaving shed. Generally, such machines have been constructed with a picking mechanism for picking a projectile across a weaving shed, a catcher for receiving the projectile and a projectile return conveyor for returning a caught projectile to the picking side of the machine. Machines of this type have been described, for example, in German No. PS 2,712,431.

In contrast to other weaving machines in which the weft yarn is picked by means of gripper rods, gripper bands, or compressed air or water nozzles, projectile weaving machines do not absolutely need to sever a weft yarn end on the catcher side since the position of such a yarn end is theoretically, always a defined position. However, in the other types of machines referred to, depending upon the system used, picking lengths may vary by several centimeters. Generally, these severed ends, which may vary in length, approximatly 50 millimeters to 100 millimeters, can be laid in as a cut edge, i.e. with leno yarns or removed individually by suction so as to produce a clean cut fabric edge. Further, the weft ends may be introduced by selvedge layers into the following shed.

However, when an air nozzle yarn layer (insertion device) is used instead of a mechanical yarn layer in a projectile weaving machine, variations in the position of the weft yarn end occur when the yarn end is transferred on the picking side to the projectile which generally has a gripper open and ready to receive a yarn end. These variations subsequently appear on the cloth edge on the catcher side as laid-in weft ends of unequal lengths. The main reason for these variations in length is that before any picked weft yarn is severed on the picking side, the state of tension varies slightly from weft to weft. As a result, the spring-back of each yarn differs.

Accordingly, it is an object of the invention to improve a projectile weaving machine so that variations in the weft yarn ends on the cloth edge are obviated with very little loss of material.

It is another object of the invention to provide a relatively simple means for ensuring a clean-cut fabric edge on a fabric woven in a projectile weaving machine.

It is another object of the invention to reduce the waste of material in the weaving of textiles in a projectile weaving machine.

Briefly, the invention provides a projectile weaving machine with a picking mechanism for picking a projectile with a weft yarn therein through a shed, a catcher for receiving a picked projectile, a projectile return conveyor for returning a projectile from the catcher to the picking mechanism and a cutting means adjacent the catcher for severing a weft yarn end at the catcher before the release of the weft yarn end from the projectile.

Consequently, not only does the weft yarn end always have the same length but also the severed yarn end can be adjusted to an optimally reduced length. Thus, waste material is reduced to a minimum.

The weaving machine is also provided with a pneumatic means for removing a severed weft yarn end from an open projectile. For example, the pneumatic means may include a suction tube for drawing a severed weft yarn end thereinto and a blowing nozzle for blowing a stream of air through an open projectile which is aligned with the suction tube in order to blow the severed weft yarn end into the suction tube. Further, the blowing nozzle may have a branch extending into the suction tube in order to intensify the suction force created therein.

The invention also provides a method of picking a weft yarn into a weaving shed which is comprised of the steps of gripping a weft yarn in a clamp of a projectile, picking the projectile through a weaving shed from a picking side to a catching side, catching the projectile on the catching side and severing the weft yarn on the catching side while retaining a severed weft yarn end in the projectile.

In one embodiment, the projectile is moved to a predetermined ejection position and, thereafter, the projectile clamp is opened in the ejection position and the severed weft yarn end pneumatically removed from the opened projectile.

In another embodiment, the projectile is returned from the catching side to the picking side and, thereafter, the clamp of the projectile is opened and the severed weft yarn end pneumatically removed from the opened projectile. In this embodiment, the need to provide a projectile opener on the catcher side is eliminated.

Since the cutting means is to be actuated only after retraction of the projectile into an ejection position, a considerable amount of material can be saved since the weft yarn end is severed only after reaching a minimum length.

The use of the pneumatic means for removing the severed weft yarn end provides a very simple and low cost removal technique for removing the weft yarn ends. Further, the use of a suction tube and blowing means for the pneumatic means provides for very economical guiding of the air for the removal of the severed weft yarn end.

These and other objects and advantages of the invention will become more apparent from the following detailed description taken in conjunction with the accompanying drawings wherein.

Figure 1:
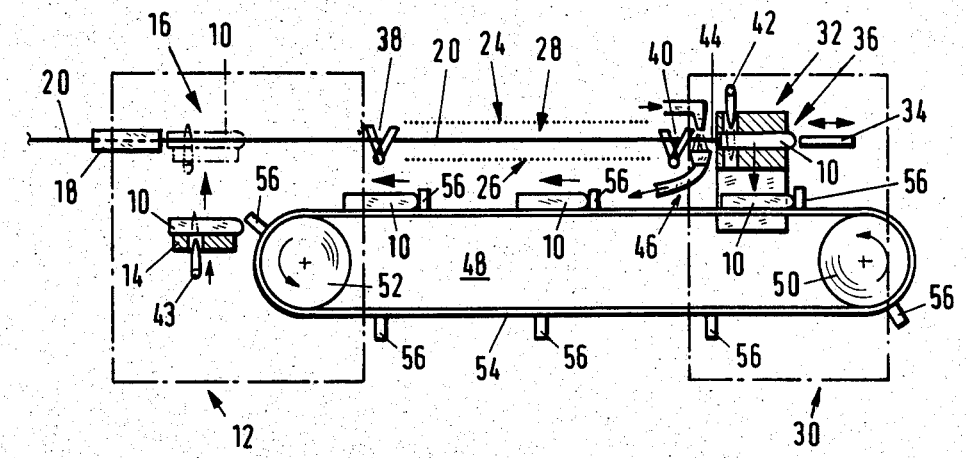
FIG. 1 illustrates a diagrammatic view of a projectile weaving machine constructed in accordance with the invention.

Referring to FIG. 1, the projectile weaving machine is constructed in generally conventional fashion with a picking mechanism 12 for picking a projectile 10 with a weft yarn 20 therein through a shed 28, a catcher 30 for receiving a picked projectile on the opposite side of the shed 28 and a projectile return conveyor 48 for returning a projectile 10 from the catcher 30 to the picking mechanism 12.

As indicated, the picking mechanism 12 includes a lift 14 for moving a projectile 10 from the conveyor 48 to a picking position (shown in dotted line) in the picking mechanism 12. For example the lift 14 is pivotally mounted to move between the indicated positions of FIG. 1. In addition, a projectile opener 43 is movable with the lift 14 in order to open a projectile 10 in the lift 14.

A yarn layer 18 (yarn insertion device) which may be a mechanical device or an air nozzle is positioned in the picking mechanism 12 so as to introduce the weft yarn 20 into an opened clamp (not shown) of the projectile 10.

The shed 28 is formed by top warp yarns 24 and bottom warp yarns 26 in known manner so that a projectile 10 may be picked therethrough from the picking mechanism 12 to the catcher 30.

The catcher 30 is provided with a retarder 32 which receives a picked projectile 10 as well as a retractor 34 for moving a caught projectile into a predetermined ejection position 36. In addition, a projectile opener 42 is positioned for opening a projectile 10 in the ejection position 36.

The return conveyor 48 is in the form of a conveying chain 54 which runs about sprockets 50, 52 and which carries entraining members 56 for moving a series of projectiles 10 from the catcher 30 back to the picking mechanism 12 for a repeat of the picking cycle.

The projectile weaving machine also has a cutting means 38 on the picking side for severing a picked yarn 20. In addition, a cutting means 40 is disposed adjacent to the catcher 30 for severing a weft yarn end in a projectile 10 disposed in the ejection position 6. After a weft yarn 20 has been severed by the cutting means 38, 40 a reed (not shown) beats up the picked weft yarn into a cloth (not shown).

In addition, a pneumatic means 46 is disposed adjacent to the cutting means 40 for removing a severed weft yarn end 44 from a projectile 10 in the ejection position 36. In this regard, the cutting means 40, the retractor 32 and the projectile 10 are controlled, in a known manner, for example by cams (not shown) to ensure that the cutting means 40 and the projectile opener 42 operate only after the retractor 34 has moved the projectile 10 into the ejection position 36.

In operation, in order to pick a weft yarn into the weaving shed, the weft yarn 20 is gripped in a clamp (not shown) of the projectile 10 in the picking mechanism 12, the projectile 10 is then picked through the weaving shed 28 and thereafter caught on the catching side in the catcher 30. After the retractor 34 has moved the caught projectile 10 into the ejection position 36, the opener 42 is actuated to open the clamp of the projectile 10 and, then, the pneumatic means 46 is actuated to remove the severed weft yarn end 44 from the projectile 10.

Figure 2:
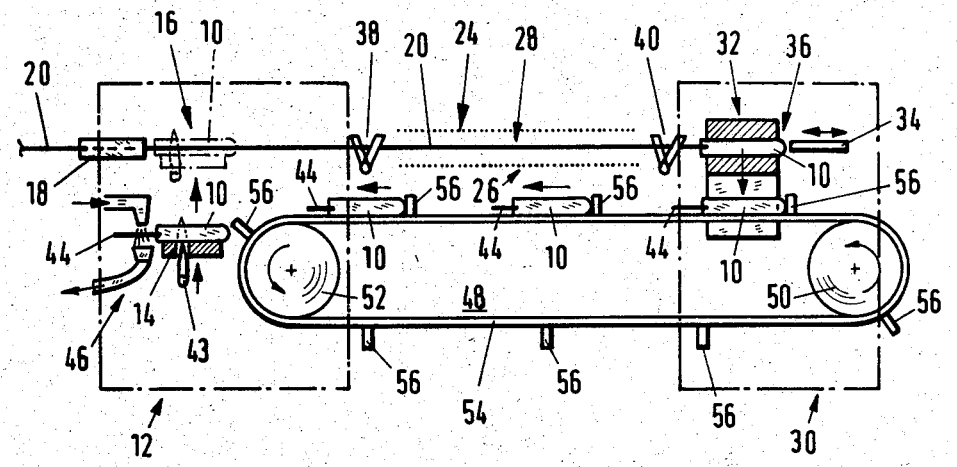
FIG. 2 illustrates a modified embodiment of a projectile weaving machine constructed in accordance with the invention.

Referring to FIG. 2, wherein like reference characters indicate like parts as above, the projectile opener 42 in the catcher side may be omitted and the pneumatic means 46 may be transferred to the picking side of the machine. In this case, the severed weft yarn end 44 remains in the projectile during return to the picking side on the conveyor 48. In this case also, the opener 43 in the picking mechanism 12 is employed to not only open the projectile 10 to receive a fresh weft yarn 20 but also to permit removal of a severed weft yarn end 44.

Figure 3:
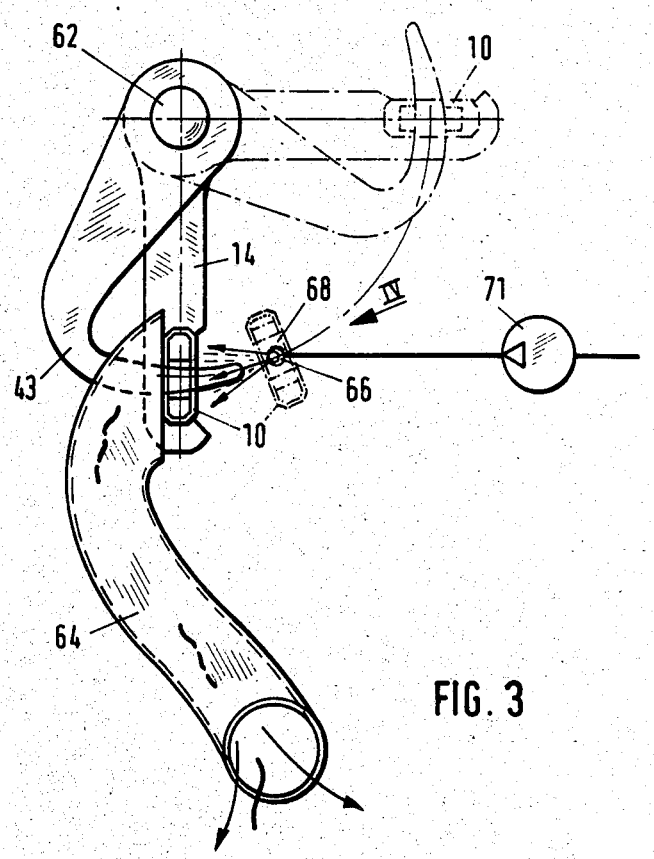
FIG. 3 illustrates a side view of a pneumatic means and projectile opener positioned in accordance with the invention.
Figure 4:
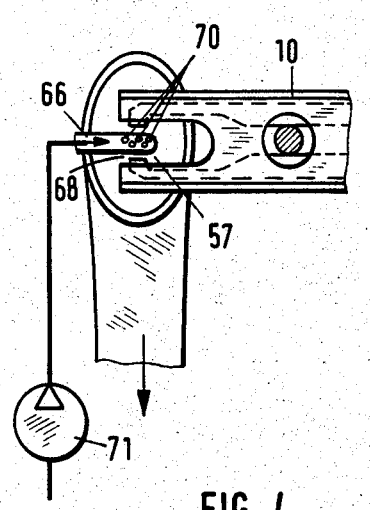
FIG. 4 illustrates a view taken in the direction indicated by arrow IV in FIG. 3.

Referring to FIGS. 3 and 4, where the projectile 10 has a clamp 57, insertion of the opener 43, in known manner, into the projectile housing causes opening of the clamp so that a severed weft yarn end therein is released. In this regard, the lift 14 which receives the projectile 10 from the conveyor 48 (see FIG. 2) is pivotally mounted so as to move from a vertical position, as illustrated, into a horizontal position, as indicated in dotted line in FIG. 3. Prior to pivoting from the vertical position, the opener 43 is inserted into the projectile 10 in order to open the clamp 57. At this time, the pneumatic means 46 is able to remove the severed weft yarn end 44.

Referring to FIG. 3, the pneumatic means 46 includes a suction tube 64 for drawing a severed weft yarn end thereinto and a blowing nozzle 66 for blowing a stream of air through an opened projectile 10 aligned with the suction tube 64 in order to blow the severed weft yarn end into the suction tube 64.

As indicated in FIGS. 3 and 4, the blowing nozzle 66 is indicated in the path of movement of the opened projectile 10 on the lift 14. Further, as indicated in FIG. 4, the nozzle 66 has a plurality of apertures 70 which are directed towards the suction tube 64 in order to blow streams of air through the opened clamp 57 of the projectile 10 into the suction tube 64. In this regard, the aperture 68 created by the opened clamp 57 is sufficient to permit passage of the nozzle 66 therethrough when the projectile 10 is pivoted into the upper position indicated in FIG. 3.

The blowing nozzle 66 is connected via a suitable line to a compressor 71 which serves to generate a stream of air for passage from the nozzle 66 towards the suction tube 64.

Figure 5:
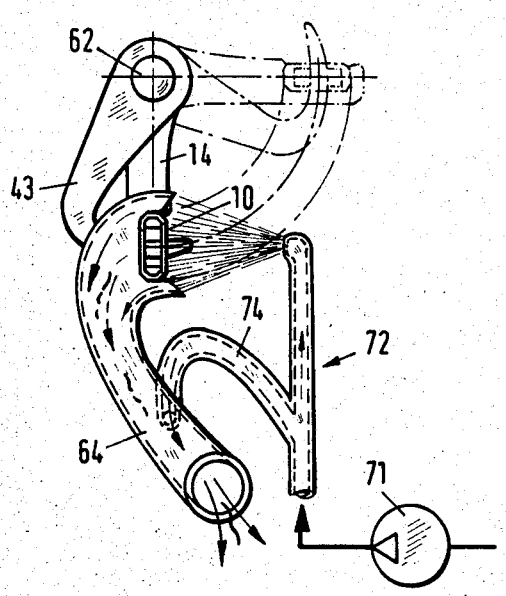
FIG. 5 illustrates a modified pneumatic means employing a branched blowing tube for removing a severed weft yarn end in accordance with the invention.

Referring to FIG. 5, the blowing nozzle 72 may be provided with a branch 74 which extends into the suction tube 64 in order to intensify the suction force created in the suction tube 64.

By providing the blowing nozzle 66 and suction tube 64, a very economical air guidance system is provided for removing the severed weft yarn ends 44 from the respective projectiles 10.

Referring to FIG. 3, during operation, after a projectile 10 has been positioned in the lift 14, the pivotally mounted opener 43 is inserted into the projectile 10 to open the clamp 57 (as indicated in FIG. 4). Thereafter the air stream from the blowing nozzle 66 is able to blow the released weft yarn end into the suction tube 64 for removal. Next, the lift 14 and opener 43 are pivoted simultaneously into the upper dotted line position indicated in FIG. 3 so that the opened projectile may receive a fresh weft yarn.

By severing the weft yarn before the projectile is opened, a precise length of weft yarn is established between the cutting means 38, 40 so that clean cut ends can be formed in a fabric into which the weft yarns are beat-up. Further, by positioning the projectiles in a predetermined ejection position 36, the amount of waste produced by the severed weft yarn ends can be held to a minimum.

The invention thus provides a projectile weaving machine in which clean cut fabric ends can be made and in which there is a minimum of waste produced from the severing of weft yarns.

What is claimed is:

1. A projectile weaving machine comprising a picking mechanism for picking a projectile with a weft yarn therein through a shed;

a catcher for receiving a picked projectile;

a projectile return conveyor for returning a projectile from said catcher to said picking mechanism;

a cutting means adjacent said catcher for severing a weft yarn end at said catcher; and a pneumatic means for removing a severed weft yarn end from a projectile, said pneumatic means including a suction tube for drawing a severed weft yarn end thereinto and a blowing nozzle for blowing a stream of air through an opened projectile aligned with said suction tube to blow a severed weft yarn end into said suction tube.

2. A projectile weaving machine as set forth in claim 1 wherein said blowing nozzle has a branch extending into said suction tube to intensify a suction force created therein.

3. A projectile weaving machine comprising a picking mechanism for picking a projectile with a weft yarn therein through a shed;

a first cutting means adjacent said picking mechanism for severing a picked yarn;

a catcher for receiving a picked projectile, said catcher including a retractor for moving a caught projectile into a predetermined ejection position;

a second cutting means adjacent said catcher for severing a weft yarn end in a projectile disposed in said ejection position; and a pneumatic means for removing a severed weft yarn end from a projectile, said pneumtic means including a suction tube for drawing a severed weft yarn end thereinto and a blowing nozzle for blowing a stream of air through an opened projectile aligned with said suction tube to blow a severed weft yarn end into said suction tube.

4. A projectile weaving machine as set forth in claim 3 wherein said pneumatic means is positioned adjacent said second cutting means.

5. A projectile weaving machine as set forth in claim 3 further comprising a projectile return conveyor for returning a projectile from said catcher to said picking mechanism, said pneumatic means being positioned adjacent said picking mechanism.

6. A projectile weaving machine as set forth in claim 3 which further comprises a projectile opener for opening a projectile in said ejection position to release a severed weft yarn end therefrom and said pneumatic means is positioned at said ejection position for removing the severed weft yarn end from an opened projectile.

7. A projectile weaving machine as set forth in claim 3 which further comprises a projectile opener for opening a projectile at said picking mechanism to release a severed weft yarn end therefrom and said pneumatic means is positioned adjacent said picking mechanism for removing the severed weft yarn end from an opened projectile.

8. A projectile weaving machine as set forth in claim 7 wherein said picking mechanism includes a lift for moving a projectile from said conveyor to a picking position in said picking mechanism, a projectile opener movable with said lift to open a projectile in said lift and said pneumatic means adjacent said lift for removing a severed weft yarn end from an opened projectile.

9. A projectile weaving machine as set forth in claim 8 wherein said blowing nozzle is positioned in a path of movement of an opened projectile on said lift, said nozzle having orifices for blowing a stream of air through an opened projectile.

10. A method of picking a weft yarn into a weaving shed comprising the steps of gripping a weft yarn in a clamp of a projectile;

picking the projectile through a weaving shed from a picking side to a catching side thereof;

catching the projectile on said catching side;

severing the weft yarn on the picking side and the catching side while retaining a severed weft yarn end in the projectile; and thereafter opening the clamp of the projectile and pneumatically removing the severed weft yarn end from the opened projectile.

11. A method as set forth in claim 10 which further comprises the step of moving a projectile to a predetermined ejection position, opening the projectile clamp in said ejection position and pneumatically removing the severed weft yarn end from the opened projectile.

12. A method as set forth in claim 10 which further comprises the steps of returning a projectile from the catching side to the picking side, opening the clamp of the projectile on said picking side end pneumatically removing the severed weft yarn end from the opened projectile.

* * * * *